United States Patent [19]

Dietz

[11] 3,947,220

[45] Mar. 30, 1976

[54] FUEL IGNITION CONTROL ARRANGEMENT

[75] Inventor: Gerald Edward Dietz, Goshen, Ind.

[73] Assignee: Johnson Service Company, Milwaukee, Wis.

[22] Filed: Oct. 21, 1974

[21] Appl. No.: 516,374

[52] U.S. Cl. ..... 431/80; 317/96; 431/27; 431/71

[51] Int. Cl.[2] ..... F23H 5/12

[58] Field of Search ..... 431/71, 78, 69, 27, 80; 317/96

[56] References Cited

UNITED STATES PATENTS

| | | | |
|---|---|---|---|
| 3,574,496 | 4/1971 | Hewitt | 431/71 |
| 3,732,433 | 5/1973 | Lourigan | 431/69 X |
| 3,840,322 | 10/1974 | Cade | 431/78 |
| 3,847,533 | 11/1974 | Riordan | 431/78 |

*Primary Examiner*—Edward G. Favors

[57] ABSTRACT

A control arrangement for igniting gaseous fuel supplied to a main burner of a fuel ignition system includes a spark producing circuit to ignite the gaseous fuel for establishing a flame at the main burner, a flame sensing circuit for detecting the presence and absence of the flame, and a switching circuit responsive to the flame sensing circuit detecting the presence of the flame for maintaining a control circuit enabled to hold the valve operated and for de-activating the spark producing circuit when the flame becomes established. In the event of a flame-out condition, the flame sensing circuit enables the switching circuit to activate the spark producing circuit to attempt to re-establish the flame. A timing circuit responds to the flame sensing circuit detecting the absence of the flame for maintaining the control circuit enabled for a predetermined time and for causing the control circuit to be disabled to turn off the valve and interrupt the flow of fuel to the main burner whenever the flame fails to be re-established within the predetermined time.

20 Claims, 2 Drawing Figures

FUEL IGNITION CONTROL ARRANGEMENT

BACKGROUND OF THE INVENTION

1. Field of the Invention

The present invention relates to a fuel ignition control arrangement, and more particularly relates to an automatic fuel ignition system automatically providing ignition and reignition of a gaseous fuel.

2. Description of the Prior Art

Control arrangements for fuel systems have been employed to control selectively the burner apparatus of the systems. For example, as disclosed in United States patent application Ser. No. 422,692, filed Dec. 7, 1973, entitled FUEL IGNITION CONTROL ARRANGEMENT, a fail-safe timing circuit is employed in a fuel ignition system to enable the main burner apparatus of a heating system to be activated tentatively by opening a valve to permit the flow of gaseous fuel under pressure so that the fuel could be ignited. The fail-safe timing circuit de-activates the valve and the ignition circuit after a predetermined time-out interval in the event that the flame is not established to prevent undesirable and unwanted escaping of unburned gas from the main burner apparatus. While such a fail-safe timing circuit is reliable and efficient in operation, it would be highly desirable to have such a timing circuit control arrangement and also the ability to shut off the flow of fuel in the event that the flame becomes extinguished inadvertently as a result for example, of being blown out or for any other reason. Moreover, such a control arrangement should also attempt to re-establish the flame before interrupting the flow of fuel following a flame-out condition. All of these capabilities of the control arrangement should be embodied in a highly reliable and efficient circuit arrangement.

SUMMARY OF THE INVENTION

Therefore, it is the principal object of the present invention to provide a new and improved fuel ignition control arrangement, which in the event of a flame-out automatically attempts reignition of the fuel before interrupting the flow of fuel to burner apparatus.

The present invention provides a new and improved igniter circuit and a control arrangement including the igniter circuit for use in an automatic fuel ignition system which includes a valve for controlling the flow of a gaseous fuel to a burner apparatus for ignition by sparks produced by the igniter circuit.

The igniter circuit includes a spark producing means, a flame sensing means, and a switching means. The spark producing means is enabled by the switching means to generate ignition sparks in the proximity of the burner for igniting gaseous fuel supplied to the burner. The flame sensing means is operable whenever a flame is established at the burner to disable the switching means for deactivating the spark producing means. In the event of a flame outage, the flame sensing means reenables the switching means to activate the spark producing means to attempt reignition of the fuel.

The control arrangement provided by the present invention includes the igniter circuit and a control means which controls the operation of the valve for supplying fuel to the burner. When a flame is established, the flame sensing means maintains the control means enabled so that fuel continues to be supplied to the burner as long as the flame is present. Should the flame become extinguished, the valve is maintained operated for a predetermined time interval while reignition is attempted. To this end, a timing means responsive to the flame sensing means detecting the absence of the flame, maintains the control means enabled for a predetermined time interval after the flame is extinguished. If the flame fails to be reestablished within such time interval the control means is then disabled, deactivating the valve to interrupt the flow of fuel to the burner.

Thus, in the control arrangement of the present invention, the flame sensing means controls both the activation of the spark producing means and the operation of the fuel supply valve. In the event of flame outage, the control arrangement automatically attempts reignition of the fuel before interrupting the flow of fuel to the burner.

In accordance with one embodiment, the control arrangement is energized by a 120 volt AC voltage to permit the igniter circuit to produce a high magnitude spark. In a further embodiment, the control arrangement includes an inverter circuit energized from a DC source to produce a 120 volt AC voltage to the igniter circuit. In this embodiment, there is provided a protection arrangement which prevents the valve from being held open in the event of a malfunction in the control means which controls the operation of the valve.

DESCRIPTION OF A PREFERRED EMBODIMENT

Figure 1:
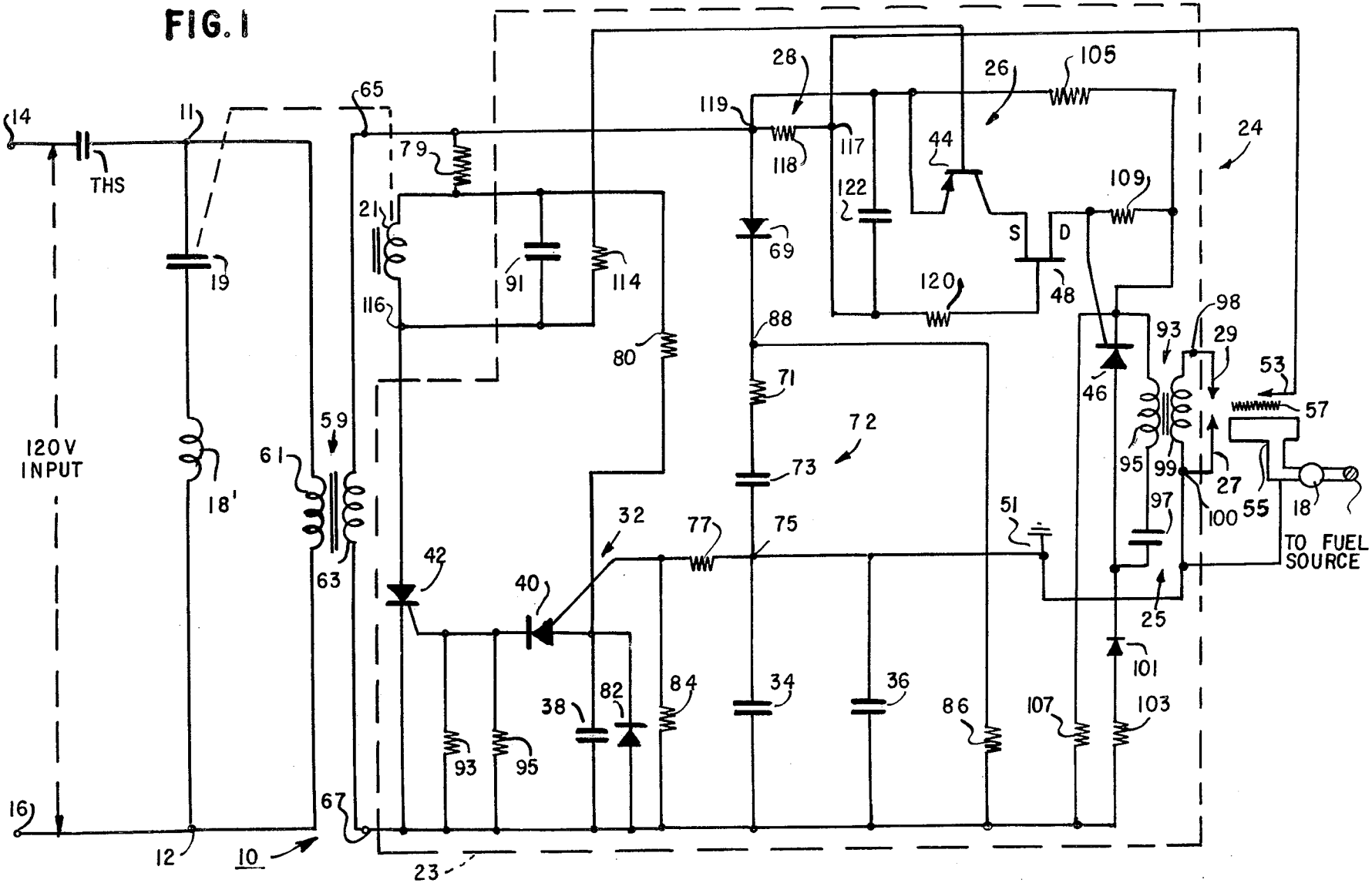
FIG. 1 is a schematic diagram of a control arrangement for a fuel ignition system in accordance with the present invention.

Referring now to the drawings, and more particularly to FIG. 1 thereof, there is shown a control arrangement 10 provided in accordance with the present invention. The control arrangement 10, which may be employed in a fuel ignition system (not shown), includes a pair of input terminals 11 and 12 connected to a pair of terminals 14 and 16, respectively, which are in turn connected to a source (not shown) of 120 volts AC power. The input terminal 11 is connected through a thermostatically-controlled normally-open switch THS and the terminal 14. The terminal 12 is connected directly to the terminal 16.

A control valve 18 supplies gaseous fuel under pressure to a main burner apparatus 55 of the fuel ignition system. The control valve 18 has an operating winding 18' connected beetween the terminals 11 and 12 through a pair of normally-open contacts 19 of a relay 21. With the arrangement 10 of the present invention, the main gas valve 18 is operated for a short period of time of, for example, five to fifteen seconds, as defined by a predetermined start-up time delay interval for the purpose of establishing a flame as hereinafter described in greater detail. If a flame is not established within the predetermined start-up time delay interval, the main burner valve 18 is de-activated. Such a direct ignition heating system requires that any type of component failure that may occur must be fail safe, that is, the gas supply and ignition circuit must be shut off.

The control arrangement 10 further includes a control circuit 23 having an igniter circuit indicated generally at 24 and a control circuit 32. The igniter circuit 24 includes a spark producing circuit 25 for generating sparks across the gap of a pair of spaced-apart electrodes 27 and 29 to ignite gaseous fuel supplied to the main burner 55, when the main burner valve 18 is operated. The igniter circuit 24 further includes a switching circuit 26 which controls the enabling of the spark producing circuit 25 and a flame sensing circuit 28 which detects the presence and absence of the flame and control the enabling of the switching circuit 26.

The control circuit 32, which includes a pair of redundantly connected parallel capacitors 34 and 36, a capacitor 38, a programmable unijunction transistor 40 and a silicon controlled rectifier 42, is enabled in response to operation of the thermostatically-controlled switch THS to cause silicon controlled rectifier 42 to conduct for the purpose of operating the relay 21. When relay 21 is operated, contacts 19 are closed effecting energization of winding 18' to operate valve 18 for supplying fuel to the burner 55 for ignition by sparks produced by the spark producing circuit 25. If a flame fails to be established within a predetermined time, transistor 40 becomes cut off, causing the silicon controlled rectifier 42 to de-energize the relay 21 deactivating valve 18 thereby interrupting the flow of fuel to the main burner 55.

In order to cause the spark producing circuit 25 to initiate the production of its sparks, a transistor 44 of the switching circuit 26 is rendered conductive in response to the conduction of the silicon controlled rectifier 42 to cause in turn the conduction of a silicon controlled rectifier 46 of the spark producing circuit 25 for turning it on via normally conducting field effect transistor 48 of the switching circuit 26.

A sensing probe 53 of the flame sensing circuit 28 is disposed in close proximity with the main burner 55 for sensing the main burner flame 57 to cause the transistor 48 to be rendered non-conductive for turning off the spark producing circuit 25 when the flame 57 is established. In accordance with the present invention, the flame sensing probe 53 also maintains the charge on the capacitors 34 and 36 of the valve control circuit 32 to cause the silicon-controlled rectifier 42 to remain conductive when the flame is established to thereby maintain the valve 18 operated.

If the flame 57 should be extinguished inadvertently, the flame sensing circuit 28 causes the transistor 48 to turn on the spark producing circuit 25 before the gaseous flow is interrupted to attempt reignition of the main burner flame. A timing circuit 72 including diode 69, resistors 71 and 86, and capacitor 73 maintains the silicon controlled rectifier 42 conductive which in turn holds relay 21 operated for a predetermined time interval after loss of flame. If the flame fails to be reestablished within the time interval, the silicon controlled rectifier 42 is rendered non-conductive interrupting the flow of gaseous fuel by turning off the valve 18.

Considering now the control arrangement 10 in greater detail with reference to FIG. 1 of the drawings, the transformer 59, over which the 120 AC voltage is supplied to the control arrangement, has an input winding 61 connected across the terminals 11 and 12 and has an output winding 63 connected across a pair of terminals 65 and 67 to the control circuit 23. A suitably-poled diode 69 connects the terminal 65 through a series-connected resistor 71 and a timing capacitor 73 of the timing circuit 72 to a point 75, which is grounded at point 51 and which is connected to the upper ends of parallel capacitors 34 and 36, the lower ends of which are connected to the terminal 67. The resistor 77 connects the point 75 to the gate of the PUT transistor 40 for control purposes. The anode of the PUT transistor 40 is connected over resistors 80 and 79 to terminal 65. The capacitor 38 is connected between the anode of the transistor 40 and the terminal 67. A suitably-poled diode 82, connected in parallel with the capacitor 38, prevents the discharge of capacitor 38 during the half cycle of the applied voltage when the terminal 67 is positive relative to terminal 65. A resistor 84 is connected between the gate of the transistor 40 and the terminal 67 for biasing purposes. Resistor 86, of the timing circuit 72 is connected between the terminal 67 and a point 88 between the diode 69 and the resistor 71 to provide a discharge path for the capacitor 73.

Considering now the relay 21 in greater detail, relay 21 is connected between a current limiting resistor 79 and the anode of silicon controlled rectifier 42. Relay 21 has normally-open contacts 19 connected between the winding 18' of the main valve 18 and terminal 11. A capacitor 91 is connected in parallel with the relay 21 to make it slow-to-release so that when the silicon controlled rectifier 42 is alternatively rendered conductive and non-conductive at a high rate of speed relative to the slow-to-release delay time of the relay 21 produced by its capacitor 91, the relay 21 remains operated. The cathode of the silicon controlled rectifier 42 is connected to the terminal 67 and the gate of silicon controlled rectifier 42 is connected to the cathode of the PUT transistor 40. A pair of redundant parallel-connected resistors 93 and 95 are each connected between the gate of the silicon controlled rectifier 42 and terminal 67 for biasing purposes. It should be understood that the resistors 93 and 95 are provided for safety purposes so that should one of them become inadvertently open-circuited, the other one continues to maintain a biasing potential for the silicon controlled rectifier 42. Similarly, the capacitors 34 and 36 are provided in duplicate for safety purposes.

Considering now the spark-producing circuit 25 in greater detail, a transformer 93 has its primary winding 95 connected in series with a capacitor 97 across the cathode-anode circuit of the silicon controlled rectifier 46.

A charging path for capacitor 97 is provided from terminal 67 over resistor 103, a suitably-poled blocking diode 101, capacitor 97, the input winding 95 of the transformer 93, a resistor 105 to terminal 65.

The silicon controlled rectifier 46 is rendered conductive and non-conductive alternately during successive half cycles of the applied current, to permit capacitor 97 to discharge over winding 95 to thereby provide high voltage pulses in a secondary winding 99 of transformer 93. One of the ignition electrodes 29 is connected to one end 98 of the secondary winding 99 and the other ignition electrode 27 is connected to the other end 100 of the winding 99. The end 100 of the winding 99 is also connected to ground potential at point 51. The electrodes 27 and 29 are positioned adjacent the burner 55 and are spaced apart providing a gap therebetween. Accordingly, each voltage pulse induced in the secondary winding 99 is applied to the electrodes 27 and 29 producing an ignition spark in the proximity of the burner 55.

A biasing resistor 107 is connected between the cathode of silicon controlled rectifier 46 and terminal 67. A biasing resistor 109 is connected between the gate and the cathode of silicon controlled rectifier 46.

The operation of the silicon controlled rectifier 46 and thus the operation of the spark producing circuit 25 is controlled by the switching circuit 26 including field effect transistor 48 and transistor 44. The gate of the silicon controlled rectifier 46 is connected directly to the drain of the field effect transistor 48, which drain is also connected through the biasing resistor 109 to the cathode of the silicon controlled rectifier 46. The source of the field effect transistor 48 is connected to the collector of the transistor 44, which has its emmiter connected to the terminal 65.

As indicated above, transistor 44 which is normally non-conducting is rendered conductive in response to the enabling of silicon controlled rectifier 42. A resistor 114 connects a point 116 between the relay 21 and the silicon controlled rectifier 42 to the base of the transistor 44 for controlling its operation so that when silicon controlled rectifier 42 is conducting, the potential at point 116 causes transistor 44 to conduct.

When transistor 44 conducts, a path is completed from terminal 65 over the emitter-collector circuit of transistor 44, through the source and drain of transistor 48 to the gate of silicon controlled rectifier 46, through resistor 107, establishing a turnon voltage for silicon controlled rectifier 46.

The switching circuit 26 is in turn controlled by the flame sensing circuit 28 which effects turnoff of the spark producing circuit upon detection of the presence of the main burner flame 57. The flame sensing circuit 28 includes a resistor 118 connected between the sensing electrode 53 at point 117 and the terminal 65 at point 119. A capacitor 122 is connected between the electrode 53 and the terminal 65.

When the flame is established, flame rectified current flow is provided over a path from terminal 65 over resistor 118, the sensing electrode 53, the flame to the burner 55 which is connected to ground at point 51. When the flame is established, a voltage provided across resistor 118 is extended through a resistor 120 to the gate of the field effect transistor 48 causing the transistor 48 to pinch off whereby the path for supplying the gate voltage to the silicon controlled rectifier 46 is removed and silicon controlled rectifier 46 becomes non-conductive. Accordingly, the spark producing circuit 25 is de-energized to prevent further sparks from being established between the electrodes 27 and 29.

In accordance with the present invention, the flame-sensing circuit 28 not only effects shut off of the spark-producing circuit 25 when the flame 57 is established, but the flame-sensing probe 55 also employs the potential at point 119 established by the rectified flame current to maintain the voltage across the capacitor 34 and 36. Accordingly, transistor 40 is maintained conductive such that silicon controlled rectifier 42 and thus the relay 21 remain operative. Thus, the main gas valve 18 remains operated and fuel continues to be supplied to the main burner apparatus 55 as long as the flame 57 is present.

OPERATION

Assume now that before the power is applied to the terminals 14 and 16 of the control arrangement 10, there is no secondary voltage across the winding 63 and that the relay 21 is not operated. When power is applied to the primary winding 61 of the transformer 59, an AC voltage is developed across the secondary winding 63 of the transformer 59. When the terminal 67 becomes positive relative to terminal 65 during a first half cycle of the applied AC voltage, the capacitor 97 of the spark producing circuit 25 charges from the terminal 67 through resistor 103, the diode 101 to the capacitor 97 and from there through the resistor 105 back to the other terminal 65. The charge remains on the capacitor 97 when the terminal 65 becomes positive relative to terminal 67 due to the blocking diode 101.

When the terminal 65 becomes positive during a second half cycle of the AC voltage across the secondary winding 63, the parallel capacitors 34 and 36 quickly become charged from the terminal 65 through the diode 69, the resistor 71 to the capacitors 34 and 36 via the capacitor 73. Resistor 86 serves as a discharge path for the capacitor 73 to reset the arrangement after normal operation thereof. The voltage across the capacitors 34 and 36, which are connected over the resistor 77 to the gate of the programmable unijunction resistor 40, establishes a gate potential therefor as is more fully described in the above-cited co-pending patent application.

During the same positive half cycle for charging the capacitors 34 and 36, the capacitor 38 is charged over a path extending from the terminal 65, the resistor 79, the resistor 80, the capacitor 38 and from there to the terminal 67 for the purpose of establishing a potential at the anode of the transistor 40. The diode 82 prevents the capacitor 38 from discharging during the half cycle when the terminal 67 becomes positive. The resistance-capacitance delay of the resistor 80 and the capacitor 38 is selected such that some time before the peak of the AC line voltage during the positive cycle at the terminal 65, the anode-to-gate potential of the transistor 40 exceeds approximately +0.6 volts so that the transistor 40 conducts and thus permits the capacitor 38 to discharge. This resistance-capacitance delay also allows the capacitor 38 to charge to a voltage sufficient to effect the generation of a voltage pulse across the parallel resistors 93 and 95 so that the silicon controlled rectifier 42 becomes conductive.

When the silicon controlled rectifier 42 is rendered conductive, an energizing path is completed between the terminal 65, and the relay 21 and the silicon controlled rectifier 42 through its anode and cathode path to the terminal 67, whereby the relay 21 operates to close its contacts 19 for the purpose of energizing winding 18' to operate valve 18, enabling gaseous fuel under pressure to flow to the main burner 55. When the silicon controlled rectifier 42 becomes conductive and voltage across the resistor 114 is applied to the base of the transistor 44, the transistor 44 is rendered conductive to complete a path from the terminal 65 through the emitter and collector of the transistor 44, through the source and drain of the field effect transistor 48 to the gate of the silicon controlled rectifier 46, to the cathode of silicon controlled rectifier 46 and through resistor 107 to terminal 67, establishing a positive voltage between the gate and cathode of the silicon controlled rectifier 46. This positive gate voltage causes silicon controlled rectifier 46 to become conductive and permit capacitor 97 of the spark producing circuit 25 to discharge through the input winding 95 of the high voltage pulse transformer 93, inducing a high voltage pulse in the secondary winding 99, which voltage is applied to the ignition electrodes 27 and 29, producing a spark between the electrodes 27 and 29 to ignite the gas flowing from the main burner 55.

The foregoing operational description relative to establishing a flame indicates the operation of the control circuit 23 for a given cycle of the applied AC voltage. It should be noted that if the main burner gas is not ignited, transistor 40 is rendered conductive during alternate half cycles of the applied AC voltage under the control of capacitors 34, 36 and 38 providing pulses for gating silicon controlled rectifier 42 into conduction to maintain relay 21 operated. As indicated above, once operated, relay 21 is maintained operated by capacitor 91 during the half cycles in which silicon controlled rectifier 42 is non-conductive.

The pulsing of transistor 40 continues until a flame is established or until capacitor 73 becomes fully charged. While capacitors 34 and 36 are being charged over capacitor 73 and discharged during alternate half cycles, the charging and discharge rate of capacitor 73 is such that capacitor 73 eventually becomes fully charged. After the ignition time interval defined by the charging time of capacitor 73, capacitors 34 and 36 are prevented from charging, and accordingly, transistor 40 and silicon controlled rectifier 42 do not conduct. Under such conditions, relay 21 releases, after the time delay provided by capacitor 91, de-energizing the valve 18.

While silicon controlled rectifier 42 is being gated to conduction by transistor 40, transistor 44 of the switching circuit 26 is also rendered alternately conductive and non-conductive in accordance with the potential at point 116 to extend an enabling signal to the gate of silicon controlled rectifier 46 of the spark producing circuit 25 effecting discharge of capacitor 97 to produce ignition sparks during alternate half cycles of the applied AC voltage. At the end of the ignition time interval when transistor 40 and silicon controlled rectifier 42 are maintained cutoff, transistor 40 is also cutoff to inhibit further spark generation in the event the main burner gas is not ignited.

When the flame 57 at the main burner 55 becomes established, the flame sensing electrode 53 senses the existence of the flame 57 by enabling current to flow from the terminal 65, through the resistor 118 and through the flame 57 to the ground at point 51. In accordance with the present invention, the flame rectified current provides the following separate functions:

1. The voltage across the resistor 18 provides a signal through the resistor 120 to the gate of the field effect transistor 48 to cause it to be rendered non-conductive and thus to open the circuit for the current flowing to the spark producing circuit 25 which is thus disabled. Thus, when the main burner flame 57 becomes established, the spark generation is terminated.

2. The rectified flame current also causes the maintenance of the voltage across the parallel capacitors 34 and 36 so that transistor 40 is maintained conducting whereby silicon controlled rectifier 42 and the relay 21 remain activated to maintain the main valve 18 operated to supply fuel to the main burner 55.

When the main burner gas becomes lit, the potential across the parallel capacitors 34 and 36 enables a potential to exist across the capacitor 73 to limit charging of capacitor 73. Should the main burner gas flame 57 becomes extinguished for any reason, the flame rectified current through resistor 118 ceases. Capacitor 73 charges towards fully charged condition when terminal 65 becomes positive, current flowing through diode 69, resistor 71, capacitor 73 and capacitors 34 and 36. This maintains capacitors 34 and 36 charged, maintaining relay 21 energized until capacitor 73 becomes fully charged. At this point, capacitors 34 and 36 discharge through resistors 77 and 84, removing the gate potential from transistor 40, allowing relay 21 to release.

During this relight time interval, the spark-producing circuit 25 is enabled to attempt to relight the flame by producing sparks between the electrodes 27 and 29. When the main burner gas flame 57 is extinguished, the spark generation commences due to the loss of potential across the resistor 118 which causes the field effect transistor 48 to conduct enabling the silicon controlled rectifier 46 to be pulsed, as transistor 44 is rendered conductive and non-conductive, thereby causing the generation of sparks to attempt reestablishment of the main burner flame.

When capacitor 73 becomes fully charged, as was previously stated, relay 21 de-energizes to close main valve 18, and stop operation of spark-producing circuit 25 as described.

In one exemplary embodiment, the components of the control arrangement 10 may have the values listed in Table I.

Table I

| | |
|---|---|
| Capacitor 34 | 0.22 microfarads |
| Capacitor 36 | 0.22 microfarads |
| Capacitor 38 | 0.33 microfarads |
| PUT 40 | SPU 35 |
| SCR 42 | C106B |
| Transistor 44 | 2N5355 |
| SCR 46 | C106B |
| FET 48 | 2N5458 |
| Diode 69 | 1N5059 |
| Resistor 71 | 680K Ohms |
| Capacitor 73 | 1.0 microfarads |
| Resistor 77 | 2.2 M Ohms |
| Resistor 79 | 470 Ohms |
| Resistor 80 | 390 K Ohms |
| Diode 82 | 1N5059 |
| Resistor 84 | 330 K Ohms |
| Resistor 86 | 1.0 M Ohms |
| Capacitor 91 | 22 microfarads |
| Capacitor 97 | 1.0 microfarads |
| Diode 101 | 1N5059 |
| Resistor 103 | 1.5 K Ohms |
| Resistor 105 | 470 Ohms |
| Resistor 107 | 33 K Ohms |
| Resistor 109 | 1 K Ohms |
| Resistor 114 | 33 K Ohms |
| Resistor 118 | 560 K Ohms |
| Resistor 120 | 1.0 M Ohms |
| Capacitor 122 | 680 Picofarads |

Figure 2:
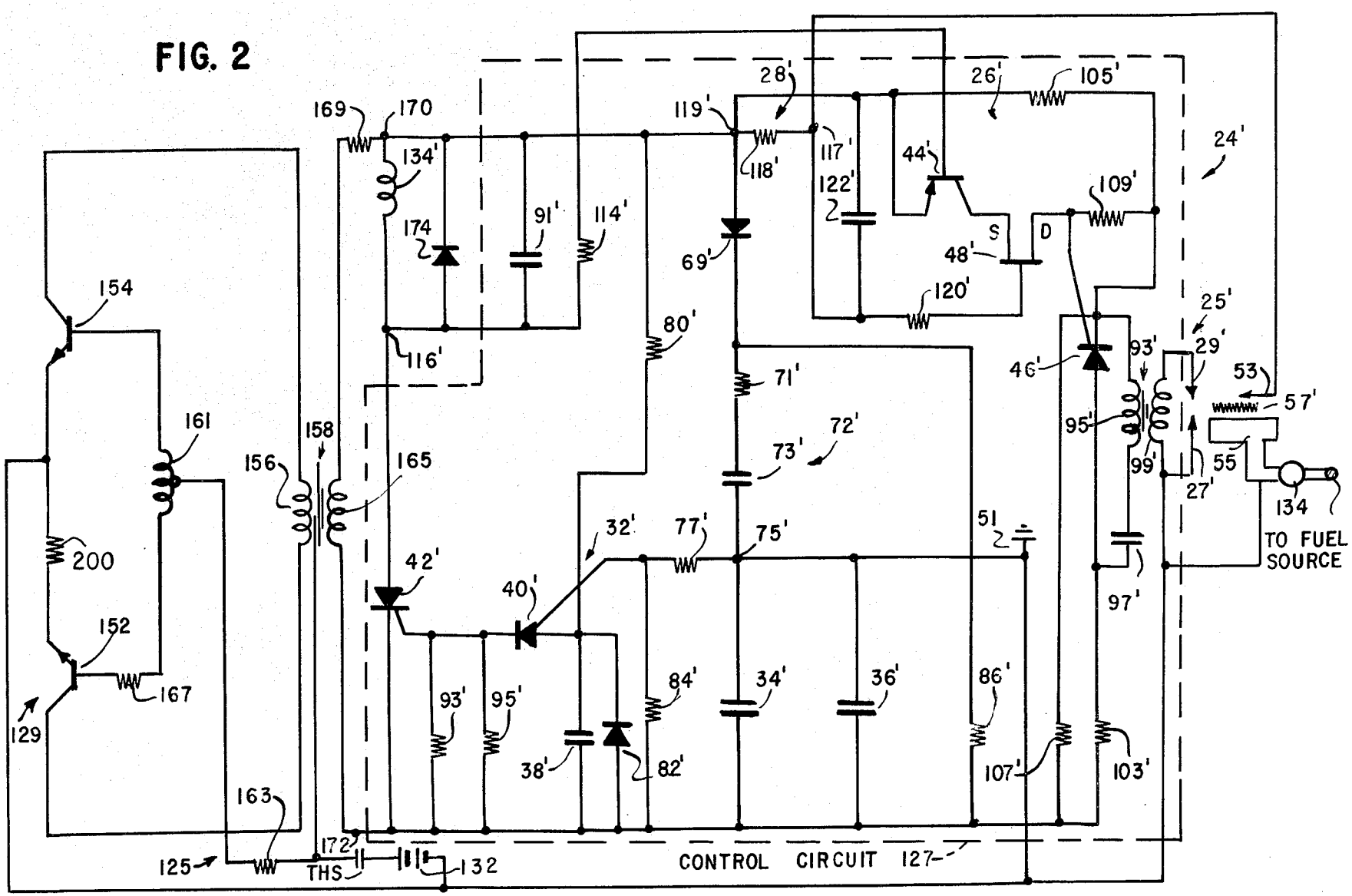
FIG. 2 is a schematic diagram of another control arrangement for a fuel ignition system in accordance with the present invention.

Referring now to FIG. 2 of the drawings, there is shown a control arrangement 125, which is constructed in accordance with the present invention, and which is similar to the arrangement 10, except that the arrangement 125 is designed to be portable and is adapted to be energized by a battery rather than a 120 volt source of AC power. Thus, the arrangement 125 is designed to be used for portable applications, such as in recreational vehicles.

The arrangement 125 generally comprises a control circuit 127 which is identical in all respects to the control circuit 23 of FIG. 1, and an inverter circuit 129 powered by means of a battery 132 for supplying power to the circuit 127. A main gas valve 134, which is opened under the control of the circuit 127, permits gaseous fuel under pressure to be supplied to a burner 55' for ignition by sparks produced between ignition electrodes 27' and 29'. An igniter circuit 24' effects ignition of the fuel and detects the presence of the flame 57'.

The control circuit 127 includes all of the same circuit elements and components as the control circuit 23 of FIG. 1 and the corresponding circuit elements and components shown in FIG. 2 of the circuit 127 are designated with the same reference character as the reference characters of FIG. 1 with the addition of a prime notation. It should be noted that in place of the relay 21 of FIG. 1, the operate winding 134' of the valve 134 of the arrangement 125 is directly energized by the silicon controlled rectifier 42' instead of first operating a relay which in turn operates the main burner valve.

Considering now the arrangement 125 in greater detail, the inverter circuit 129 includes a pair of transistors 152 and 154, transistor 152 is connected through a resistor 200 to the emitter of transistor 154, which in turn is connected to the grounded negative terminal of the battery 132. The collectors of transistors 152, 154 are connected to the opposite ends of a winding 156 of a three-winding transformer 158. A winding 161 of the transformer 158 has one end 162 connected over a resistor 167 to the base of the transistor 152 and a second end 164 connected to the base of transistor 154. Center tap terminals of the windings 156 and 161 are connected to opposite ends of a resistor 163 with the center tap of the winding 156 being connected over normally open switch contacts THS to the positive terminal of the battery 132. An output secondary winding 165 of the transformer 158 supplies 120 volt AC voltage to energize the control circuit 127. The upper end of the winding 165 is connected through a resistor 169 to a terminal 170 which corresponds to the terminal 65 of the arrangement 10 of FIG. 1. The opposite end of the output winding 165 is connected to a terminal 172 which corresponds to the terminal 67 of FIG. 1.

In operation, when switch contacts THS are closed, the transistors 152 and 154 are rendered alternately, conductive and non-conductive to cause an alternating current to be induced in the secondary output winding 165 of the transformer 158. A diode 174 is connected in parallel with the valve winding 134' and the capacitor 91' to further facilitate the maintenance of the field for the operation of the valve 134.

In accordance with the present invention, the control arrangement 125 shown in FIG. 2 includes a novel safety circuit which prevents the main valve 134 from being held open in the event of a short across silicon controlled rectifier 42'. As noted above, the inverter circuit 129 converts DC potential from the battery 132 to 120 volts AC for the main valve energizing circuit. The resistor 167, connected in the base circuit of transistor 152, provides voltage regulation, the resistor 200 enables an imbalance condition to be established for the inverter circuit 129 when a short across the anode-cathode of the silicon controlled rectifier 42' occurs.

More specifically, in the case of a short across the silicon controlled rectifier 42', a sufficient load is put upon transformer winding 165 to cause an induced voltage to be fed back to the winding 156 of the inverter 129. This induced voltage attempts to provide a large current through the feedback circuit to winding 61 in the base circuit of transistors 154 and 152. The resistor 200 causes an imbalance of the inverter circuit 129 causing transistor 154 to be rendered and maintained conducting. This condition causes transistor 152 to be maintained non-conducting. Accordingly, the inverter circuit 129 fails to convert the DC voltage to an AC voltage for the control circuit 127. The inverter circuit 129 then provides only DC power to the control circuit preventing energization of the main valve 134, a fail-safe condition.

It will be readily apparent to those skilled in the art that the present invention provides a novel and useful improvement in the fuel ignition control arrangement of the character described herein. The arrangement and type of structural components and inter-connections utilized within the purview of this invention, such modifications might well include the substitution for the valve 134 and the diode 174 of the arrangement 125 with a relay such as the relay shown in FIG. 1 to be operated by the control circuit 127 to in turn close a pair of normally-open contacts for connecting the winding of the main burner valve across the terminals of the battery whereby the valve would then be a lower voltage DC valve instead of a higher voltage AC valve.

In one exemplary embodiment, the components of the control arrangement 125, other than the control circuit 127, may have the values listed in Table II.

Table II

| | |
|---|---|
| Transistors 152, 154 | D44C8 |
| Resistor 163 | 680 Ohms |
| Resistor 167 | 18 Ohms |
| Resistor 169 | 470 Ohms |
| Resistor 200 | 3.9 Ohms |
| Diode 174 | 1N5059 |

I claim:

1. In an automatic fuel ignition system having valve means operable when energized to supply gaseous fuel under pressure to a burner apparatus, a control arrangement for controlling the operation of said valve means and for effecting ignition of fuel supplied to said burner apparatus, said control arrangement comprising control means operable to energize said valve means for a first duration, ignition means including spark producing means including electrode means positioned adjacent said burner apparatus, discharge means coupled to said electrode means, means for enabling said discharge means to be charged to a predetermined potential, and controlled switching means operable when enabled to cause said discharge means to discharge to thereby apply a high voltage pulse to said electrode means for generating an ignition spark in the proximity of said burner apparatus for igniting fuel from said fuel outlet to establish a flame, and enabling means controlled by said control means to extend enabling signals to a control electrode of said controlled switching means to effect periodic enabling of said controlled switching means, flame sensing means operable when a flame is established to enable said control means to remain operated when a flame is established to thereby maintain said valve means operated, and to control said enabling means for preventing said enabling signals from being extended to said control electrode of said controlled switching means to thereby disable said controlled switching means, said flame sensing means being operable in the event the flame becomes extinguished to control said enabling means to permit further enabling signals to be extended to said control electrode of said controlled switching means for enabling said controlled switching means, whereby said spark producing means is activated to effect the generation of further ignition sparks and to cause said control means to remain operated for a second duration after the flame is extinguished to thereby maintain said valve means energized for said second duration, said control meand deenergizing said valve means and said ignition means whenever a flame fails to be reestablished within said second duration.

2. A control arrangement as set forth in claim 1 wherein said enabling means includes first switching means operated by said control means to effect periodic enabling of said spark producing means, and a second switching means responsive to a control potential provided by said flame sensing means to inhibit said spark producing means when a flame is established.

3. A control arrangement as set forth in claim 2 wherein said flame sensing means includes sensing electrode means positioned in the proximity of said burner apparatus in spaced-apart relationship therewith providing a gap therebetween and circuit means connecting said electrode means in a circuit path to permit flame rectified current to flow over said circuit path whenever a flame bridges said gap, for establishing said control potential.

4. A control arrangement as set forth in claim 3 wherein said control means includes further switching means operable when enabled to energize said valve means, pulsing means for providing control pulses for operating said further switching means for said first duration, and timing means responsive to said control potential for controlling said pulsing means to maintain said further switching means enabled when a flame is established.

5. A control arrangement as set forth in claim 4 wherein flame rectified current flow over said circuit path is interrupted when the flame is extinguished preventing said control potential from being maintained, permitting said timing means to control said pulsing means to maintain said further switching means enabled for said second duration, said timing means disabling said pulsing means to disable said further switching means when the control potential fails to be reestablished during said second duration.

6. A control arrangement as set forth in claim 4 wherein said first switching means comprises first transistor means and second means comprises second switching transistor means, said second transistor means being normally conductive, said first transistor means being normally non-conductive and being rendered conductive whenever said further switching means is operated to extend an enabling signal over a further circuit path including said second transistor means to said control input of said controlled switching means to enable said controlled switching means, said second transistor means being rendered non-conductive by said control potential when a flame is established to interrupt said further circuit path to thereby inhibit said controlled switching means.

7. In an automatic fuel ignition system having valve means operable when energized to supply gaseous fuel under pressure to a burner apparatus, a control arrangement for controlling the operation of said valve means and for effecting ignition of fuel supplied to said burner apparatus, said control arrangement comprising energizing means operable to control the energization of said valve means, timing means for supplying pulses to said energizing means for a predetermined time for periodically enabling said energizing means to energize said valve means for said predetermined time, ignition means including spark producing means and enabling means including first and second switching means operable when enabled to provide a series circuit path between a source of enabling signals and a control input of said spark producing means, said second switching means being normally enabled, and said first switcing means being enabled by said energizing means to permit said enabling signals to be extended over said circuit path to said control input effecting periodic enabling of said spark producing means to generate ignition sparks for igniting fuel supplied to said burner apparatus to establish a flame, flame sensing means operable when a flame is established to disable said second switching means while said first switching means remains enabled to thereby interrupt said circuit path to inhibit said spark producing means and to control said energizing means to maintain said valve means energized when a flame is established, said flame sensing means being operable in the event the flame becomes extinguished to enable said second switching means to thereby complete said circuit path to permit further enabling signals to be extended to said control input for enabling said spark producing means to effect the generation of further ignition sparks and to cause said energizing means to deenergize said valve means and said ignition means after a predetermined time whenever a flame fails to be reestablished within said predetermined time.

8. A control arrangement as set forth in claim 7 wherein said energizing means includes first means operable when enabled to energize said valve means, and pulsing means responsive to the pulses provided by said timing means to provide further pulses for enabling said first means.

9. A control arrangement as set forth in claim 8 wherein said pulsing means includes second means and circuit means including first capacitor means, said timing means supplying pulses to said pulsing means to permit said first capacitor means to charge and discharge during said predetermined time rendering said second means alternately conductive and non-conductive to provide said further pulses, said flame sensing means being operable to prevent said timing means from supplying pulses to said pulsing means when a flame is established whereby said first capacitor means remains charged to maintain said second means conductive.

10. A control arrangement as set forth in claim 9 wherein said timing means includes said second capacitor means and means for deriving said pulses from a source of AC potential, said pulses being extended to said pulsing means over said second capacitor means, enabling said second capacitor means to charge, and means for establishing a charging rate for said second capacitor means whereby said second capacitor means becomes fully charged at said predetermined time.

11. A control arrangement as set forth in claim 10 wherein said flame sensing means enables said timing means to supply pulses to said pulsing means for said predetermined time in the event the flame becomes extinguished to permit said second means to maintain said valve means operated for said predetermined time after the flame is extinguished.

12. An igniter for use in an automatic fuel ignition system for effecting ignition of a gaseous fuel emanating from a fuel outlet, said igniter comprising spark producing means including electrode means positioned adjacent said fuel outlet, discharge means coupled to said electrode means, means for enabling said discharge means to be charged to a predetermined potential, and controlled switching means operable when enabled to cause said discharge means to discharge to thereby apply a high voltage pulse to said electrode means for generating an ignition spark in the proximity of said fuel outlet for igniting fuel from said fuel outlet to establish a flame, enabling means operable to extend enabling signals to a control electrode of said controlled switching means for enabling said controlled switching means, flame sensing means operable when a flame is established at said fuel outlet to control said enabling means for preventing enabling signals from being extended to said control electrode of said controlled switching means to thereby disable said controlled switching means, said flame sensing means being operable in the event the flame is extinguished to control said enabling means to permit further enabling to be extended to said control electrode of said controlled switching means for enabling said controlled switching means whereby said spark producing means is activated to generate further ignition sparks for reestablishing a flame at said fuel outlet.

13. An igniter as set forth in claim 12 wherein said enabling means includes first switching means operable when enabled to effect periodic enabling of said controlled switching means and second switching means enabled by said flame sensing means when a flame is established for maintaining said controlled switching means disabled to inhibit said spark producing means.

14. An igniter as set forth in claim 13 wherein said flame sensing means includes sensing electrode means positioned in the proximity of said fuel outlet in spaced-apart relationship therewith providing a gap therebetween and circuit means connecting said electrode means in a circuit path to permit flame rectified current to flow over said circuit path whenever a flame bridges said gap, for establishing a control potential for enabling said second switching means.

15. An igniter for use in an automatic fuel ignition system for effecting ignition of a gaseous fuel supplied to a fuel outlet, said igniter comprising spark producing means, and enabling means including first and second switching means operable when enabled to provide a series circuit path between a source of enabling signals and a control input of said spark producing means, said second switching means being normally enabled, and said first switching means being enabled in response to the occurrence of a condition to permit said enabling signals to be extended over said circuit path to said control input of said spark producing means, said spark producing means being responsive to said enabling signal to generate ignition sparks for igniting fuel supplied to said fuel outlet to establish a flame at said fuel outlet, and flame sensing means for detecting the presence of a flame at said fuel outlet to disable said second switching means while said first switching means remains enabled to thereby interrupt said circuit path to inhibit said spark producing means, said flame sensing means enabling said second switching means in the event the flame is extinguished to thereby complete said circuit path to permit further enabling signals to be extended to said control input for enabling said spark producing means.

16. An igniter as set forth in claim 15 wherein said first switching means includes first transistor means having a control electrode, and input electrode connected to a source of enabling signals and an output electrode, and said second switching means includes second transistor means having a control electrode connected to an output of said flame sensing means, an input electrode connected to said output electrode of said first transistor means and an output electrode connected to said control input of said spark producing means, means biasing said second transistor means to be normally conductive and said first transistor means to be normally non-conductive, said first transistor means being rendered conductive in response to an enabling signal supplied to the control electrode thereof to complete said circuit path over said first and second transistor means for permitting enabling signals to be extended to said control input, said second transistor means being rendered non-conductive in response to a control signal supplied to the control electrode thereof by said flame sensing means to interrupt said circuit path when a flame is established.

17. An igniter as set forth in claim 16 wherein said spark producing means comprises ignition electrode means, discharge means, means for enabling said discharge means to charge to a predetermined voltage, controlled switching means having a control electrode connected to said control input for receiving said enabling signals to permit said controlled switching means to effect discharge of said discharge means to thereby provide high voltage pulses for application to said ignition electrode means to effect the generation of ignition sparks in the proximity of said fuel outlet.

18. In an automatic fuel ignition system including valve means operable when energized to supply gaseous fuel under pressure to a fuel outlet, and ignition means for effecting ignition of fuel supplied to said fuel outlet whenever said valve means is operated, a control arrangement for controlling the operation of said valve means, said control arrangement comprising a control circuit including switching means connected across a pair of input terminals of said control circuit, inverter means normally operable to supply an AC voltage to said input terminals for energizing said control circuit and said valve means whenever said switching means is operated, and control means connected to said input terminals and responsive to said AC voltage to enable said switching means to provide an energizing path for said valve means, said inverter means being operable to provide a DC voltage across said input terminals to thereby effect deenergization to said valve means whenever a short circuit condition occurs in said switching means.

19. A control arrangement as set forth in claim 18 wherein said inverter means includes first and second switching transistors and feedback means connected to DC source and operable to provide control signals to said transistors for rendering said first and second transistors alternately conductive and non-conductive to produce an alternating current in an output circuit of said inverter means which is connected to said input terminals, said feedback means including circuit means for causing one of said switching transistors to be maintained continuously conductive whenever a short circuit condition occurs in said switching means whereby a DC current is provided in said output circuit.

20. A control arrangement as set forth in claim 18 wherein said inverter means includes first and second switching transistors, transformer means having a first winding connected in an input circuit for said first and second switching transistors, a second winding connected in an output circuit for said switching transistors and a third winding connected to said input terminals, means for supplying a DC potential to said inverter means for enabling said switching transistors to be rendered alternately conductive and non-conductive, and circuit means including resistor means connected in the emitter circuit of one of said switching transistors for causing an imbalance condition for said inverter means whereby said one switching transistor is maintained continuously non-conducting whenever an overload is placed on said third winding.

* * * * *

UNITED STATES PATENT OFFICE

CERTIFICATE OF CORRECTION

PATENT NO. : 3,947,220

DATED : March 30, 1976

INVENTOR(S) : Gerald Edward Dietz

It is certified that error appears in the above-identified patent and that said Letters Patent are hereby corrected as shown below:

Column 11, line 41, after "second" insert -- switching --;

line 42, cancel "switching";

Column 13, line 49, "signal" should be -- signals --;

Column 14, line 43, "to" should be -- of --;

line 48, after "to" insert -- a --.

Signed and Sealed this

Second Day of November 1976

[SEAL]

*Attest:*

RUTH C. MASON
*Attesting Officer*

C. MARSHALL DANN
*Commissioner of Patents and Trademarks*